US010614671B2

(12) United States Patent
Isaac

(10) Patent No.: US 10,614,671 B2
(45) Date of Patent: Apr. 7, 2020

(54) MECHANISM FOR SPONSORSHIP WITH CONTEXTUAL TRANSACTIONS

(71) Applicant: Roger D. Isaac, San Jose, CA (US)

(72) Inventor: Roger D. Isaac, San Jose, CA (US)

( * ) Notice: Subject to any disclaimer, the term of this patent is extended or adjusted under 35 U.S.C. 154(b) by 0 days.

(21) Appl. No.: 16/030,842

(22) Filed: Jul. 9, 2018

(65) Prior Publication Data

US 2019/0139367 A1 May 9, 2019

Related U.S. Application Data

(60) Provisional application No. 62/530,231, filed on Jul. 9, 2017.

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/3244* (2013.01); *G07F 17/3262* (2013.01)

(58) Field of Classification Search
USPC ..... 463/1, 21
See application file for complete search history.

(56) References Cited

U.S. PATENT DOCUMENTS

2017/0124810 A1* 5/2017 Fraser ..... G07F 17/3293
2019/0139367 A1* 5/2019 Isaac ..... G07F 17/3288

* cited by examiner

*Primary Examiner* — Pierre E Elisca
(74) *Attorney, Agent, or Firm* — Van Court & Aldridge LLP

(57) ABSTRACT

At a high-level, method to enable viewers of online or televised gaming tournaments to actively participate in the tournament through monetary or other means.

13 Claims, 4 Drawing Sheets

MECHANISM FOR SPONSORSHIP WITH CONTEXTUAL TRANSACTIONS

CROSS-REFERENCE TO A RELATED APPLICATION

This application claims the benefit of priority of U.S. Prov. App. No. 62/530,231, filed Jul. 9, 2017, entitled MECHANISM FOR SPONSORSHIP WITH CONTEXTUAL TRANSACTIONS, by Roger D. Isaac, the contents of which are hereby incorporated by reference in their entirety.

FIELD OF THE INVENTION

This disclosure relates generally to online and televised gaming, and more specifically, to mechanisms to enable viewers to participate in online and televised gaming matches.

BACKGROUND

Currently, televised poker games are shown throughout the world as standalone games or tournaments. These games generate revenue for the hosts through advertising and ticketing. The viewership for these games is modest and generates a small amount of revenue. The gaming pots are generated through a buy-in from the players and potentially a revenue share from the advertising revenue generated from the game. What is needed is a mechanism to enable viewers of online and televised gaming to actively participate in these games and to actively put money into these games. The money that is put into the game by these participants is then placed into the game and the players are able to use this money to increase the betting pool and potential winnings. At the end of a match or tournament, this money is then returned to the viewers based on the positions that they played.

Televised Poker Games

Currently, televised poker games are shown throughout the world as standalone games or tournaments. These games generate revenue for the hosts through advertising and ticketing. The viewership for these games is modest and generates a small amount of revenue. The gaming pots are generated through a buy-in from the players and potentially a revenue share from the advertising revenue generated from the game.

CURRENT STATE OF THE ART

Current televised and live poker events are passive for viewers and while the audience may view a live event occurring, they are not able to participate in the live event or influence the outcome of the event. Viewers typically watch the best poker players in the world play and are attracted by the skill of the poker players, the amount of money involved, and the entertainment value of various bluffs and some surprising outcomes when the expected outcome does not occur due to a low probability event occurring.

BRIEF SUMMARY

What is proposed here is a method for audiences to participate in the game emotionally and monetarily. A typical person cannot play poker at the same level as a top player in the field and does not get to participate in the top games. However, through investment in player(s) in a game/tournament, the audience can participate directly in each game being played through the expertise of the individual players in the game/tournament. This allows for much larger pots being played for, higher audience participation/viewing, and results in much higher revenues for the players, the casinos, the television channels, and advertisers. As an example, if 1,000,000 viewers invest $100 each in a tournament, the final pot will be $100,000,000. This pot is then split between the winner of the tournament, the audience investors in the player, the casinos, and others. In a tournament, the games can be played over a number of weeks. Each week, the winners from each table will advance to the next round and the audience can invest additional money on the players between the rounds and before the games. Investment in earlier rounds may pay out at greater rates than investment in later rounds as the odds for the remaining players will go up in later rounds. The prize money will accumulate each week into larger and larger pots. A critical element for the investment will be odds for each player. The more money invested on a player relative to other players, the higher the odds will become for the player to win and the less money invested on a player relative to other players, the lower the odds for the player to win will become. This will incentivize the audience to spread the investments evenly across the players in the tournament. Additionally, a portion (or all) of the investment for each player may be put into a common pool that is split amongst all players in order to spread the money more evenly across all players. A commission on the investment may be taken by the casinos, the mobile app provider, the online portal, or the payment processors. By directly investing in players, the audience will have a direct influence on the game itself, as players who have more money invested in them will have an advantage over other players in the tournament. There can be additional side-investments based on other outcomes of the game, including, but not limited to: winners of each table during a round, the order of the players at the end of the round or at the end of the tournament, whether or not certain card combinations are played, etc. The money for the side-investments may be paid out at the end of the round or at the end of the tournament. While it is envisioned that the game will be played on television or online, it may also be played live in casinos for a smaller non-television audience. The games may be played by professional poker players or by personalities, such as professional sports players or movie stars.

While this is envisioned in the setting of a poker game/tournament, other types of gaming are also contemplated. These include, but are not limited to: Card games such as Blackjack, games such as backgammon, Chess or Go, online gaming tournaments, and other games of skill or chance. For example, audience participation in the games above may be used to influence the odds of the underlying game itself, with players that have more investment from the audience being put in a superior position relative to other players in the game. This may be considered similar to a "handicap" in golf, but wherein players that have audience superior audience backing are given an advantage compared with other players.

A further understanding of the nature and advantages of the embodiments discussed herein may be realized by reference to the remaining portions of the specification and the drawings.

DETAILED DESCRIPTION

Illustrative embodiments are now described more fully hereinafter with reference to the accompanying drawings, in which representative examples are shown. Indeed, the disclosed communication systems and methods may be embodied in many different forms and should not be construed as limited to the embodiments set forth herein. Like numbers refer to like elements throughout.

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

The present disclosure provides methods, computer products and systems to allow mobile and online viewers to actively participate and place wagers in online and televised gaming, and more specifically to enable gaming players to use those wagers in actively in the games that are being played.

Figure 1:
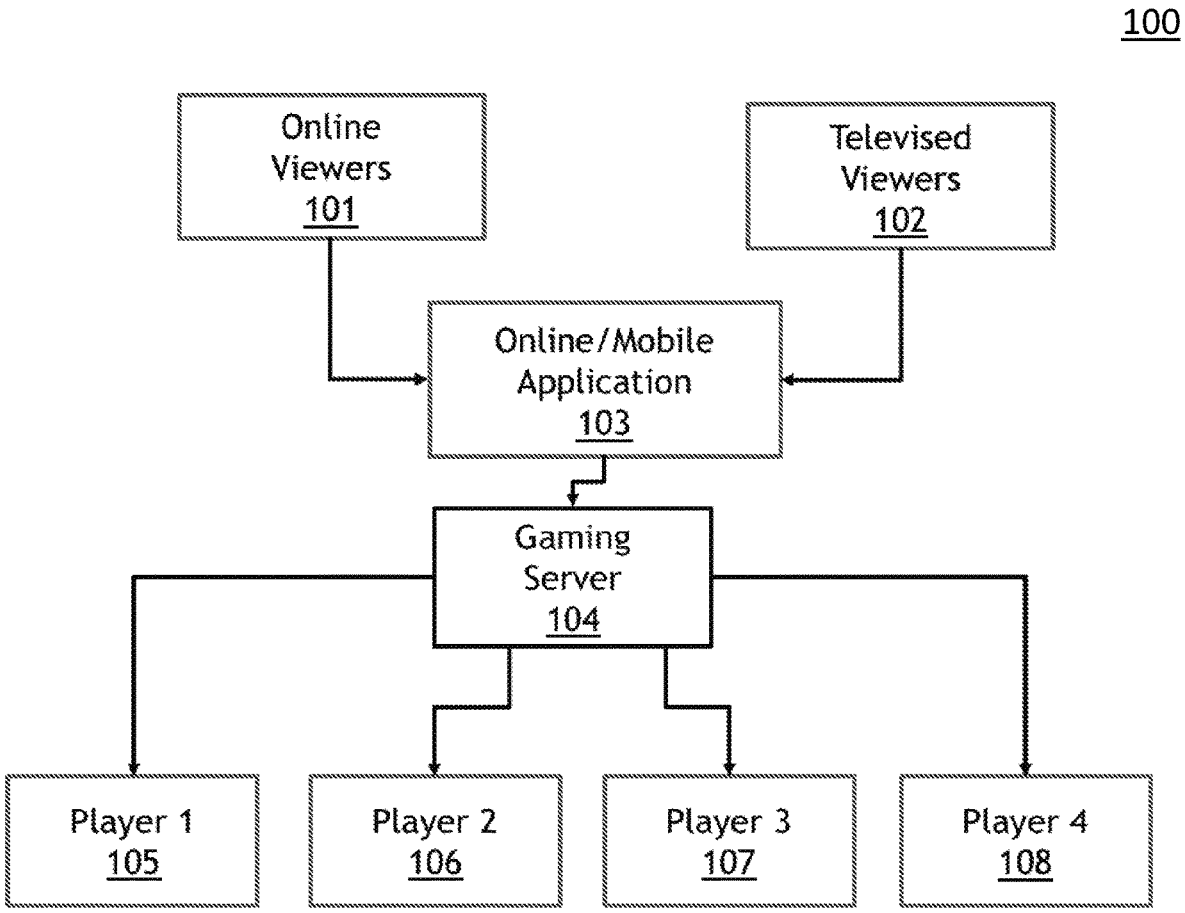
FIG. 1 is a high-level block diagram illustrating a system enabling viewers to participate in online and televised gaming, according to an embodiment.

FIG. 1—Viewer Investment 100

FIG. 1 is a high-level block diagram illustrating a method 100 for online and mobile viewers to actively invest in the televised or online gaming events. Online Viewers 101 and Televised Viewers 102 may use Online/Mobile Application 103 to actively invest in televised or online gaming events. Gaming Server 104 receives active requests from the online/mobile application and then determines which players (105, 106,107,108) receive funds from the Online Viewers 101 or Televised Viewers 102 based on the selection of the individual viewers.

At the beginning of a game or prior to a round, audience members (Online Viewers 101, Televised Viewers 102, or on-set viewers (not shown)) can invest is the poker player of their choice.

(1) They can invest directly in the outcome for the winner of the tournament (2) They can invest in an intermediate or tangential outcome (odds and payout determined separately)—these outcomes may be the Payout is based on the odds for each player. Alternatively, payout may be based on a given percentage of the overall pot and split amongst the audience members who invested in a given player. As an example, if 1,000 audience members each invested $100 in Player A, and Player A won the tournament with an overall pot of $10,000,000, and the audience take was set at 40%, then each audience member would receive ($10,000,000/1,000)*40%=$4,000. The actual payout for each audience member may be based on the amount of money that was invested by each audience member, the round in which each audience member invested, the percentage of the take set aside for the audience, the odds for the player, etc. This algorithm for the audience take may be determined at the beginning of each game, round, or tournament.

Odds for each player may be determined by the amount of money invested in a given player for each round. The odds for 100 players may start off to be 40:1 odds (for a set 40% audience take) for a game/tournament at the beginning, but these may change based on the investments in the player and the round of a given series of games or tournament. The odds may be adjusted to target a 40% take for audience members for a given player in the tournament and/or to target an even spread of money for each player in the game/tournament.

The money that a given player plays with may be a portion of the total amount of money invested in the player, a portion of the total amount invested in the game, or some combination thereof. Additionally, only a portion of the total amount of money invested may be the sum total that all players are currently playing with. In an example, if $100,000,000 is the sum total of all money that is invested at the beginning of a tournament, then each player may start with $1,000,000. At the end of the tournament, if the winner's cut is 40%, then the winner would receive $40,000,000. The audience cut may be set at 40% as well and the audience members who invested in that particular player would split $40,000,000 based on their individual investments. Alternatively, the players may only play with the portion of the money that they are set to win and each player would start out with $400,000 each if the player's cut were set to 40% of the overall take. The other money would be set aside for the investors and other parties (such as the casinos, producers, etc.)

There may be a required buy-in for players in the game/tournament. The buy-in may be set at $10,000 or $50,000 per player. This would ensure that only the best players or those that believed that they had a chance to win would be included in the tournament. Players in the tournament may be invite-only as well, wherein the producers of the game only invite the top players in the world to play. Based on how the individual game or tournament is set up, the producer/casinos may even pay players to show up to play in the tournament. These types of tournaments may include celebrity players or famous athletes and movie stars. Having well known celebrities to invest in may increase the amount of money that is invested in a given tournament by audience members.

In addition, there may be a limit to how much money can be invested in a given player. For instance, if the audience take is set at 40%, then the maximum amount of money that may be invested in a single player must be less than the overall investment by the audience in order to ensure that the audience members who invested will be able to recoup their investment in the case that this particular player wins. There are a number of ways to prevent this from occurring:

(1) Show the payout odds for a given player (the player with more investment will result in lower payout) to the point that an investment in a player will result in no positive payout or even a negative payout in the case that the player wins.

(2) Set a maximum amount of investment in a given player (as a percentage of the overall take) and prevent any investment in that player that exceeds this maximum amount. In the example shown below, this may be set to less than 30% of the overall investment.

(3) Set additional incentives to invest in other players in the tournament that are attracting low amounts of investment. These incentives could include various types of bonuses as described below.

Figure 3:
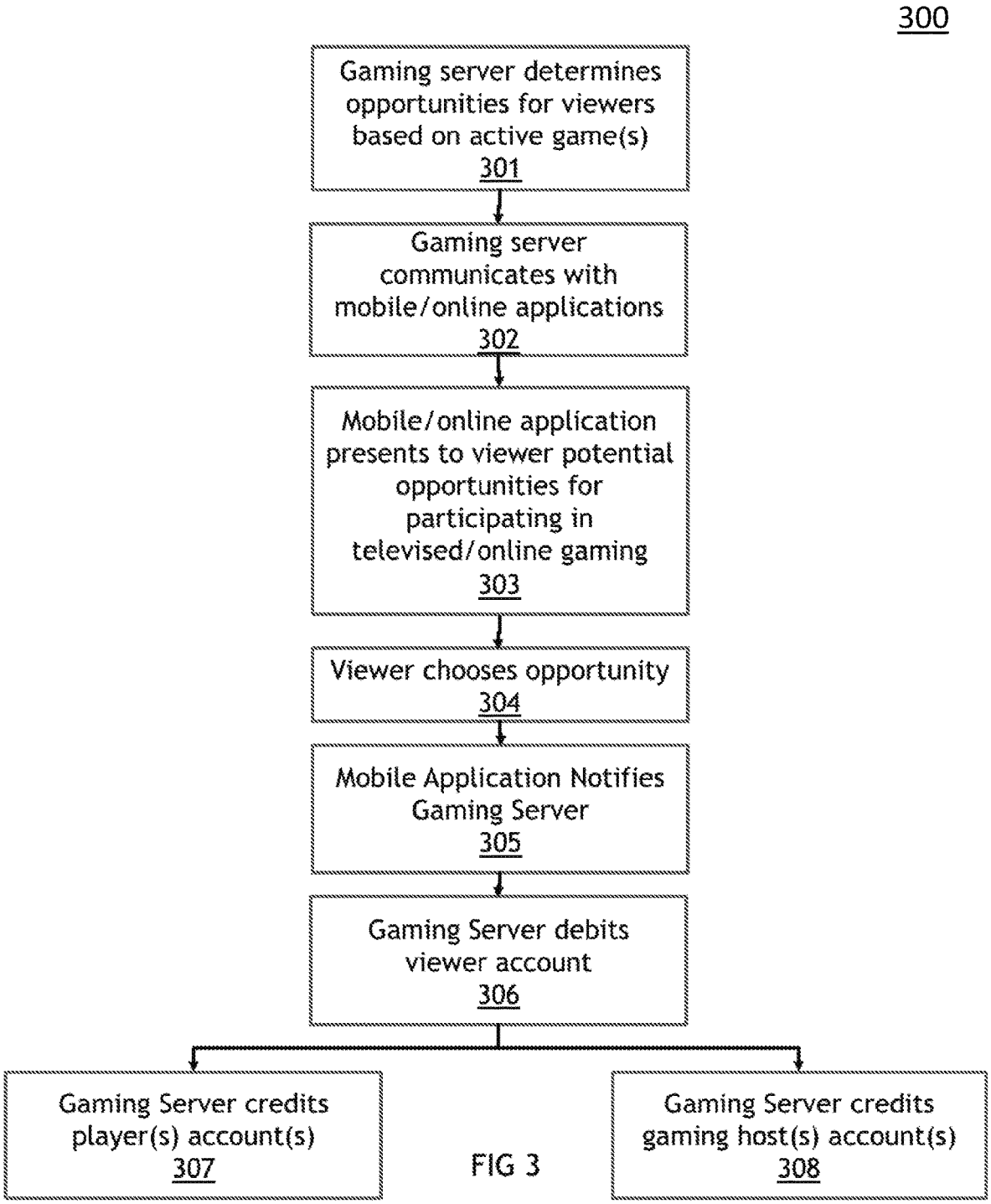
FIG. 3 is a flow diagram illustrating a method of determining current gaming opportunities for live viewers and allowing viewers to choose which opportunities to participate in according to an embodiment.

FIG. 3—Gaming Investment 300

FIG. 3 is flow diagram illustrating a method 300 for online and mobile viewers to actively invest in the televised or online gaming events. At step 301, a gaming server determines potential investment opportunities for viewers based on ongoing live games. The gaming server may make its determinations based on the current state of the game, the number of players involved, the current odds, the current hand that is being played, the amount of money being played with, the current pot, or other relevant criteria. At step 302, the gaming server communicates these investment opportunities with mobile and online applications for each viewer. At step 303, the mobile and online applications present the live viewers with investment opportunities based on the current state of the live game. At step 304, the live viewer (either online, televised, or on-set) chooses which opportunity or opportunities they wish to invest in and make a selection on the mobile application. At step 305, the mobile application notifies the gaming server on the viewers selection. At step 306, the gaming server debits the viewers account and at step 307, the gaming server credits the live player(s) accounts and at step 308 the gaming server credits the host(s) accounts. The host accounts may one or more of: a company that is hosting the mobile application, the company that is hosting the live event, and the company that is hosting the gaming server.

During the game or round, the game may be televised, shown locally at a casino, and/or distributed over a mobile application.

Figure 2:
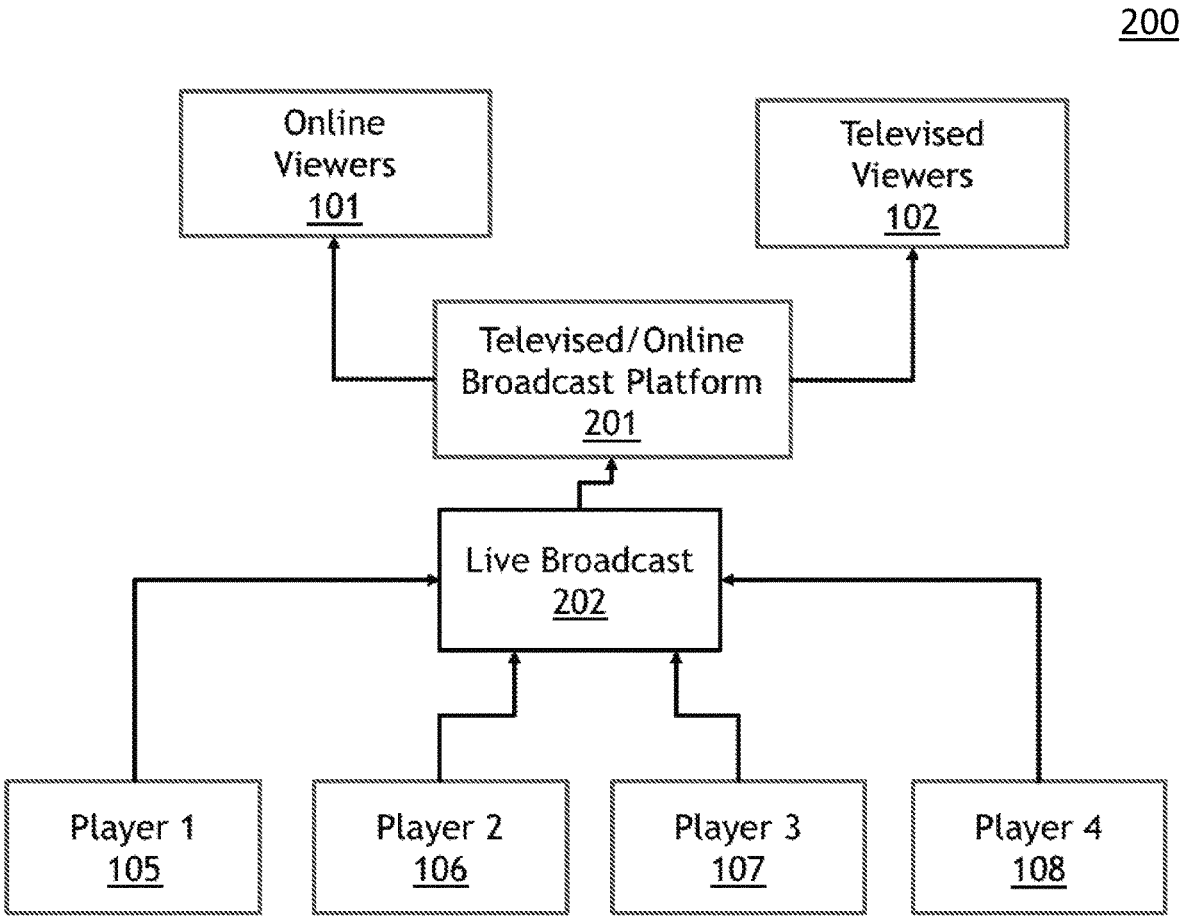
FIG. 2 is a high-level block diagram illustrating how a live gaming event is broadcast to users either online or via televised broadcast according to an embodiment.

FIG. 2—Live Broadcast 200

FIG. 2 is a high-level block diagram illustrating a method 200 for broadcasting live game events to mobile viewers 101 and televised viewers 102. During a live game, Player 1 105, Player 2 106, Player 3 107, and Player 4 108 may be playing a gaming event at single or multiple locations. The live event is consolidated by Live Broadcast 202 and sent to the Televised/online broadcast platform 201. The Televised/online broadcast platform then relays the event to Online Viewers 101 and Televised Viewers 102.

The game will be televised or shown locally in a casino with audiences watching the game/tournament. Investments on given players during the game may be disallowed to ensure that the audience does not inadvertently give private information to the players to influence the outcome of a game/round. Investment may occur for tangential outcomes, such as whether the next card turned will be an Ace, King, etc. Other tangential outcomes that may be invested on may be the suit of the cards, the order of the cards, etc. This may be done real-time with mobile apps or on-line betting. Dependent on the available technology and the ability to prevent direct influence of a given game, this feature may be enabled or disabled for a given game/tournament.

Advertisers may be better able to target the audience that is watching based on the information provided by the audience investments. For instance, if the audience is primarily determined to be male viewers between 18-49, then the advertisers can hone their message to these viewers. In addition, the location of audience members, the income bracket of the audience members and other additional information relating to the audience viewers may be made available for the advertisers.

During the broadcast, the viewership of the game/tournament may be very high, and the audience members may be reluctant to change the channel during a round. If the audience member has a stake in a game/player, the audience member may be very emotionally and monetarily invested in seeing the outcome of the game as the outcome may directly financially affect the given audience member. Also, the amount of money being played with may be considerably more with direct audience participation. A final pot of $100,000,000 may not be uncommon in these games/tournaments. This will drive viewership and media coverage of the event which may generate significant revenues for the venues and outlets producing these events.

Viewers of a given broadcast may know the strength of individual hands of all participants in a given game. This knowledge of the strength of the individual hands (and of their individual investment) may add additional excitement to users who are invested in a given game. If a user knows that their investment is strong for a given hand, the user may be more emotionally invested in the live viewing of the tournament than otherwise. Similarly, if a user knows that their investment is weak for a given hand, the user may be even more emotionally invested in the outcome of the hand. A winning bluff will bring relief and satisfaction to the user, while a losing play will increase the emotional involvement of the user. This emotional involvement may increase the television market share for the program.

Figure 4:
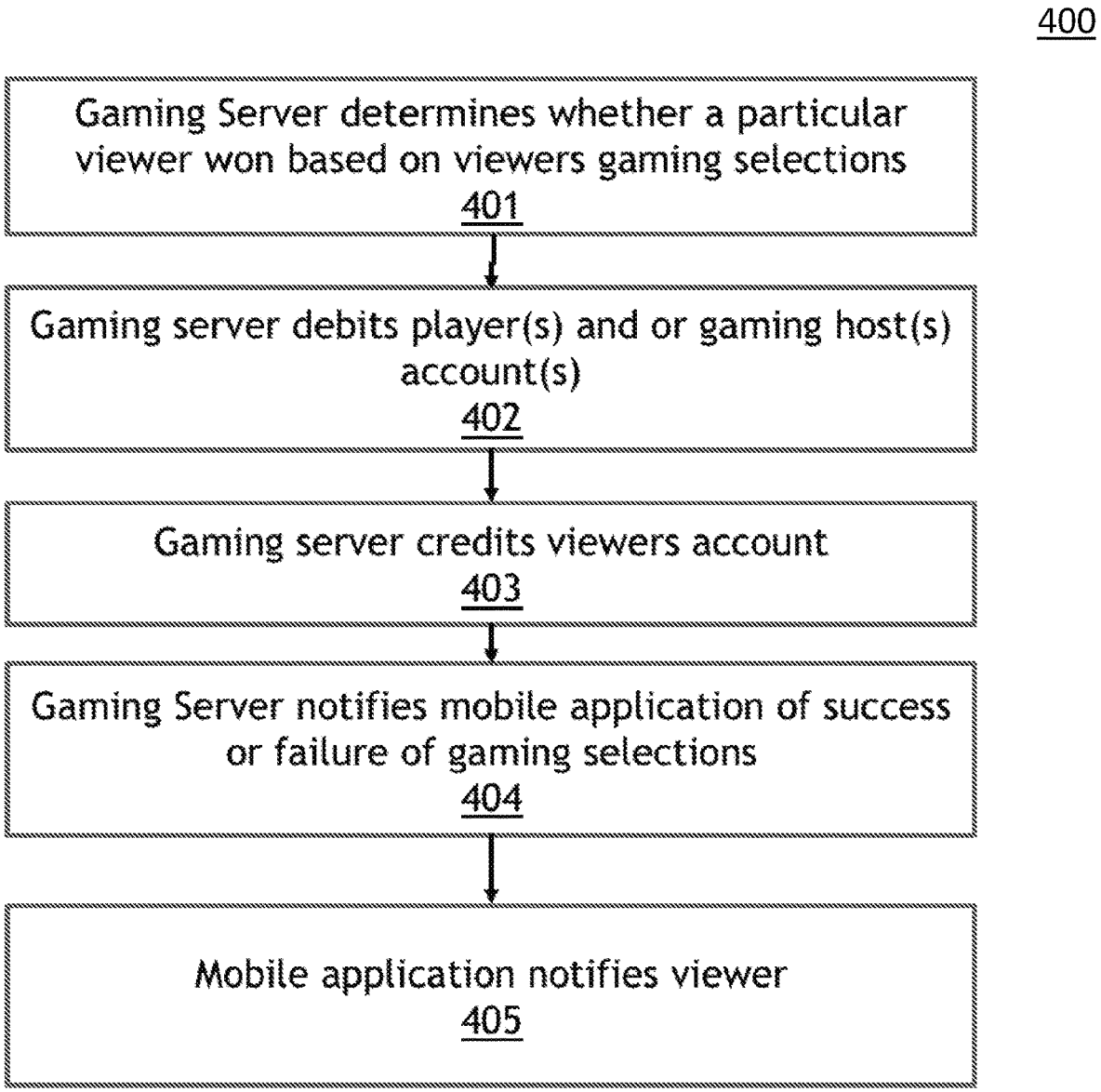
FIG. 4 is a flow diagram illustrating a method of determining whether a viewer's gaming selections were successful and providing credits based on the success of these selections according to an embodiment.

FIG. 4—Gaming Payout 400

FIG. 4 is flow diagram illustrating a method 400 applying credits to the online viewers accounts based on the outcome of a particular live game or hand. At the end of a game or tournament, payouts to successful viewers are handled by the gaming server. At step 401, a gaming server determines whether a particular viewer won a payout based on that viewers gaming selections. At step 402, the gaming server debits the live player(s) accounts gaming host(s) accounts. The host accounts may one or more of: a company that is hosting the mobile application, the company that is hosting the live event, and the company that is hosting the gaming server. At step 403, the gaming server then credits the viewers accounts based on the outcome of the game or tournament combined with the selections made by the individual viewers. The success or failure of each viewers selections are recorded by the gaming server. At step 404, the gaming server notifies the mobile application of the success or failure of the viewers gaming selections. At step 405, the mobile application notifies the viewer of the outcome and the winnings or losses incurred by the viewer.

After a given round/game, some tangential payouts may be made to audience investors, or these payouts may be paid at the end of the tournament. If they are paid immediately after the game/round, this may encourage more investment throughout the tournament. If these payouts are paid at the end of the tournament, the money can be used to increase the size of the pots for the individual players. In this case, the money would then be paid out at the end of the tournament to the individual audience investors.

In between rounds, more investment can be made on players that are still in the game. This investment may be used to boost the chances of individual players who may be at a disadvantage from the amount of money they have to play with compared with other players. The investments may be made in an individual player, but they may be split amongst all players in the tournament in some portion (including up to 100% of the money being split amongst all players).

Interviews with the players and merchandising may be made available to audience members as well. Individual players may have "Pro-tips" books or DVDs or online media made available to their investors or for purchase. Additionally, directed advertising at the investors for various related (and unrelated products) may occur via directed marketing or emails.

At the End of the Tournament

After a tournament has completed, payouts for the individual investors in the winner(s) of the tournament would be completed. These payouts may be through online accounts, direct deposits, coupons, travel vouchers, etc. Individual investors may be marketed to for participation in future tournaments, trips to casinos, seminars for learning how to play like the pros, etc.

The player(s) who won the tournament may be given a percentage of the overall pool of money played with in the game. Other player(s) who played in the top percentage of players may get paid as well. Other stake holders, such as the producers, casinos, etc. may be given a percentage of the take as well. The players in the tournament may be invited to participate in future tournaments or do seminars and tours around the world for promoting future contests.

Example Poker Game/Tournament with Investment from Viewers

Number of players: 100

Buy-in from players: $10,000 per player

Total investment from audience: $99,000,000

Total pot: $100,000,000 split amongst all players (no direct investment in player)

Beginning odds per player: 40:1

Payout Structure for Player(s):

Players % of pot (40%)

1: 30% of pot ($30,000,000)

2: 5% of pot ($5,000,000)

3: 3% of pot ($3,000,000)

4: 1.5% of pot ($1,500,000)

5: 0.5% of pot ($500,000)

Payout Structure for Investors:

Investors % of pot (40%)

1: 30% of pot ($30,000,000)

2: 5% of pot ($5,000,000)

3: 3% of pot ($3,000,000)

4: 1.5% of pot ($1,500,000)

5: 0.5% of pot ($500,000)

Payout Structure for Others:

20% of pot split between casinos, producers, etc.

$20,000,000

Example split for individual investor for with investment in player in position 1:

$30,000,000 total payout $3,000,000 total invested in player who won

Investor A invested $10,000 in player who won:

Investor A return: ($10K/$3M)*$30M

Investor A return: $100,000.

Investor B invested $100 in player who won

Investor B return: ($100/$3M)*$30M

Investor B return: $1,000.

The payouts may vary based on the round during which the investor invested in the player who won the tournament, with additional weighting given to the investors who invested in earlier rounds of the tournament.

The tournament may be played out over a period of eleven weeks, with each week focused on a table of 10 players, with one winner from each table proceeding to the final round. Alternatively, the tournament may be played out over a number of weeks wherein the final five (out of 10) from each table advancing to the next round and each of the five taking the money they won from each round into the next round (this would skew the 2nd and subsequent rounds to players who had accumulated more money). Investment from the audience between rounds may be used to boost players who are losing or to fortify the positions of players in the lead. This format would continue until the final round in which 10 players would compete for the title and the investments.

Description of Method of Investment (1) Mobile or Online Application

A mobile or online application may be provided to interested investors and participants in games and tournaments. The application allows for investors to choose their favorite player and invest in the individual prior to a game or round. The application keeps track of the amount of money that the individual invested and how their favorite player is faring in the tournament. The application may also show statistics on various players including how accurately they bet based on the cards played, how many times they bluff and what percentage of times the player is successful at bluffing. The application may also allow for side-investments on tangential outcomes, such as what the next card played will be or the likelihood that a given player or player(s) will achieve a certain outcome (such as a Royal Flush, Straight Flush, or other outcome). The application includes account and payment information for the investor and allows the investor to enter in new payment information and invest in player(s) and outcomes for various tournaments. As many games and tournaments may be being played at any given time, the application may provide access to each tournament through investment or viewing opportunities.

The application may also provide "live" statistics for each hand in play and the likely outcome for each player. The application may provide a method to invest in these outcomes based on the odds of each outcome. In one example, if Player A has a 90% chance of winning the hand and Player B has a 10% chance of winning the hand, the application may allow investment based on those outcomes. An investment in Player A may result in a small return, while investment in Player B may result in a much larger return. These investments would be tangential to the main game being played. The application and server may provide coordination with the live event to ensure that the investments can take place in time and allow for users to invest for a time period between deals or between the turning of cards. This coordination may involve direct feedback from the live event for the starting and stopping of these investments. In one example, a dealer (or server at the site of the contest) may give a green light (metaphorically speaking) for online or live viewers to investing on a given outcome. The dealer (or server) would wait for a prescribed period of time and then give a red light (metaphorically speaking) for online or live viewers to end investing on a given outcome. The green (or red) lights may be electronic signals sent to the user application to enable or disable investment on a given outcome. In addition, the server may provide investment options during each proscribed time. The investment options may include what the next card will be (Ace, King, etc.), the eventual winner of the hand, and whether or not a given player will fold, bluff, etc. The investment options may be automated by the server based on known statistics and the current status of a given hand and the known cards that have been previously drawn. At the turning of the next card or the next deal, the server will calculate the investment outcomes and credit or debit the user accounts based on these outcomes. The server may then re-calculate the odds and present new investment opportunities for users.

On the server side of the application, the gaming server will process payment information, keep track of all investments from all participants, and provide security to the critical data from each customer (such as payment data). The application and server may be configured to only work in certain jurisdictions (depending on regulatory requirements) and block access in unauthorized jurisdictions. A GPS (or other) tracking mechanism may be used to authenticate that the user is in the appropriate jurisdiction. In addition, the server side may be configured to detect fraudulent activities and report these activities to the authorities. The server side may be also configured to gather information about the users of the application (such as age, income, investment history, gender, etc.) and use the data for direct marketing to the user (either via the mobile application or via email). The mobile application may display direct marketing information directly to the user or may alert the user via pop-ups or alerts of special events, deals, or upcoming tournaments. The server may also share the user information in aggregate or in part to advertisers, online partners, television partners or others as applicable. This information may be used to direct advertising and special promotions to the investors and users of the mobile application.

The server may process payout returns for tournaments to the users and may deposit the returns directly into user accounts or may provide alternative payouts such as vacation packages, electronic goods and services, or other promotions to the users and investors.

Upon installation of the application or the registration of a user for an online application, the application will request user info, including but not limited to username, password, location, gender, age, income, payment information, and other preferences.

Upon a user selecting an investment opportunity, the mobile application will record the investment opportunity, obtain a secure connection to an associated server, and communicate payment details with the server. The server will obtain authorization for the payment, process the payment, apply the investment in the given opportunity (in one case placing the investment on a given player in a given tournament), notify the user via the application of the success or failure of the operation, track the progress of the game, round, or tournament, and update the user on the progress of their investment. Upon the conclusion of the tournament, the server will process all investments in the tournament and apply appropriate returns to the accounts associated with winning investments. The server will calculate payouts based on one or more of the following factors: the user's investment in a given player, the user's investment in a given tangential outcome, the round in which the investment was made, the total amount invested in the game or tournament, the amount invested in a player, the percentage of the total investment returned for a given outcome, the odds that the user invested on, etc. These payouts may be completed either through cash payments, credit payments, goods, offers of vacation packages, etc.

Users that invest in more than one game or tournament or meet certain criteria may be offered "bonuses" based on their investment. These bonuses may include additional funds to invest in a given player, additional funds to invest in tangential outcomes, future funds to invest in future games/tournaments, offers for vacation packages, offers to become a live participant in future tournament, goods, discounts, etc. The server may process information regarding each user and make differential offers to the user based on user information and preferences. The server may also process bonuses for referrals.

The application may also include online gaming tournaments for users. The gaming tournaments may place the user against other users, against professional users, or against computerized players. These tournaments may be free to play or they may require some form of payment. Winners and top-rated users may be invited to participate in televised games and tournaments as described above.

In one embodiment, online gaming players may be placed against televised or live gaming participants in tournaments. Online gaming players may also be televised in tournaments as well.

(2) At Casinos/Gaming Centers

As described above in the mobile and online applications, users may be presented with investment options for given outcomes and the opportunity to invest in certain players. At a casino or gaming center, additional options and investment opportunities may be offered. A live poker event may be held nightly at auditoriums within the gaming centers and live viewers may be given the opportunity to invest in the outcomes of the poker event.

In one instance, live viewers may purchase seats for the events and may also purchase investments on a given player or outcome. The poker event would be held live and the audience would watch as the tournament unfolded. Audience members who invested in the winner of the live event may be given returns in the form of cash payments, goods, offers, vacation packages, etc.

The purchase of the seats may be tied to an individual player and the investment tied directly to the purchase of the seat. In one example, an audience of 1,000 people may be split evenly between 10 different poker players. The tickets may cost $500 a piece for the audience members. The total amount invested would be $500,000 for a given event. The audience percentage of the winnings may be set higher than the televised version of the event and it may be winner take all. This percentage may be set at 50%. The winning percentage for the player may be set lower. In this case, the audience members who invested in the winning poker player may be paid up to $2,500 a piece. This payment may be made of cash, coupons, restaurant vouchers, show vouchers, goods, or other forms of payment.

It is important that the audience not interfere with the live game as it is being played out to ensure the integrity of the game. Mechanisms to prevent audience interference such as soundproofing or other mechanisms would need to be put in place. One possible solution would be that the game is played in a secure room that is visible to the audience, and the audience can watch the game unfold live, but are unable to influence the game during individual hands. A live moderator and entertainment can be provided in addition to the live game to enhance the audience experience. In between hands, the players may be invited to directly interact with the audience.

The participants in the game may be celebrities in the poker world or celebrities in the sports and entertainment worlds.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Moreover, any processes described with respect to FIGS. 1-4, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions which can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A computer-implemented method enabling an online or televised viewer to actively participate in a live game, comprising:

determining selections for the viewer based on the current state of the live game, communicating the selections to a mobile application, wherein the mobile application presents live statistics to the viewer, presenting the selections to the viewer, enabling the viewer to choose one or more of the selections on the mobile application, and communicating the viewer selection from the mobile application to a gaming server.

2. The method of claim 1, wherein determining a gaming server determines the selections.

3. The method of claim 2, wherein the mobile application communicates viewer selections to the gaming server.

4. The method of claim 2, wherein the gaming server determines the winning selections and communicates these selections to the mobile applications.

5. The method of claim 1, wherein the mobile application presents current probabilities of potential outcomes to the viewer.

6. The method of claim 5, wherein the mobile application presents selections based on the current probability of each outcome.

7. The method of claim 6, wherein the mobile application updates selections based on direct feedback from a live event.

8. The method of claim 1, wherein the gaming server limits the amount of time for a viewer to make a selection.

9. The method of claim 8, wherein the amount of time for a viewer to make a selection is based on direct feedback from a live event.

10. A computer-implemented method enabling an online or televised viewer to actively participate in a live game, comprising:

determining selections for the viewer based on the current state of the live game, communicating the selections to a mobile application, presenting the selections to the viewer, enabling the viewer to choose one or more of the selections on the mobile application, and communicating the viewer selection from the mobile application to a gaming server, wherein the gaming server limits the amount of time for a viewer to make a selection, and wherein the amount of time for a viewer to make a selection is based on direct feedback from a live event.

11. The method of claim 10, wherein determining a gaming server determines the selections.

12. The method of claim 11, wherein the mobile application communicates viewer selections to the gaming server.

13. The method of claim 11, wherein the gaming server determines the winning selections and communicates these selections to the mobile applications.

* * * * *